United States Patent [19]

Mo

[11] Patent Number: 4,745,532

[45] Date of Patent: May 17, 1988

[54] LAMPSHADE

[76] Inventor: Yhu-Kee Mo, No. 53-2, Chung Tai E. St., Pei Chu, Taichung City, Taiwan

[21] Appl. No.: 80,341

[22] Filed: Jul. 31, 1987

[51] Int. Cl.[4] ..... F21V 1/06

[52] U.S. Cl. ..... 362/352; 362/353

[58] Field of Search ..... 362/351, 352, 353, 357, 362/358

[56] References Cited

U.S. PATENT DOCUMENTS

| | | | |
|---|---|---|---|
| 3,742,210 | 6/1973 | Chapman | 362/358 |
| 3,787,676 | 1/1974 | Korach | 362/352 |
| 4,055,760 | 10/1977 | Weisbrod | 362/352 |
| 4,275,434 | 6/1981 | Borowitz | 362/352 |
| 4,290,099 | 9/1981 | Harris | 362/352 |
| 4,539,631 | 9/1985 | Lieberman | 362/351 |
| 4,625,268 | 11/1986 | Payne | 362/352 |

*Primary Examiner*—E. Rollins Cross

*Attorney, Agent, or Firm*—Limbach, Limbach & Sutton

[57] ABSTRACT

The invention relates to a lampshade which includes separable parts such as a truncated cone-shaped corrugated cover made of paper or a fabric material, curved plate segments for lining the corrugated cover, upper and lower ring members to interconnect releaseably the curved plate segments, and a rib assembly attached releaseably to the upper ring member. The parts of the lampshade can be conveniently stored and economically in a small package and easily assembled to form a lampshade.

5 Claims, 3 Drawing Sheets

LAMPSHADE

BACKGROUND OF THE INVENTION

This invention relates to a lampshade, and particularly to a improved lampshade which has a truncated cone-shaped corrugated cover made of paper or a fabric material, curved plate segments for lining the corrugated cover, and a separable frame assembly to support and interconnect the curved plate segments.

Various forms of lampshades are provided in the art. FIGS. 1 and 2 show a typical lampshade which includes a hollow truncated cone-shaped member which underlies a corrugated cover 7 and has its upper rim and lower rim fixed respectively to an upper ring 6 and a lower ring 3. To the upper ring 6 is connected fixedly a rib assembly 2 having three ribs which have their lower angled ends fixed to a rib connecting ring 5 and their upper angled ends fixed to the upper ring 6. Such a lampshade construction is not separable and foldable and thus requires a bulky package for transportation, thereby increasing the transporting cost of the lampshade. Moreover, when a number of these lampshades are stacked in a tier, the rib assemblies and the lower rings 3 must be subjected to pressure, thereby resulting in a deformation of the corrugated cover.

SUMMARY OF THE INVENTION

An object of the invention is to provide an improved lampshade which includes separable parts, thereby enabling it to be kept in a package of reduced size for facilitating the transportation and reducing the cost of the transportation.

The present invention provides an improved lampshade which comprises: a corrugated hollow outer cover of truncated cone shape having an upper hooking rim curved inwardly and a lower hooking rim curved inwardly; a plurality of curved plates shaped to a segment of a truncated hollow cone so as to be connected to one another to form an inner lining of the outer cover, each of the curved plates having an inwardly curved upper hooking edge, an inwardly curved lower hooking edge, and two opposite lateral sides to be jointed with other adjacent curved plate, the lateral sides of each curved plate being provided with engaging tongues and grooves which define right-angled shoulders; an upper ring to be hooked up by the upper hooking edges, having attachment members at intervals thereon; a rib assembly having a rib holding circular ring with a cross-section of U-shape in a radial plane and an outer periphery which has spaced apart openings therein, and a plurality of bent ribs extending upward from the rib holding ring, each of the bent ribs having a lower angled end inserted into the circular ring through the openings, each of the bent ribs extending radially from the circular ring, then bent upward and connected to the attachment members of the upper ring; and a lower ring to be hooked up by the lower hooking edges of the curved plates.

In one aspect of the invention, the attachment members include a sleeve portion sleeved around the upper ring, and an arched plate portion extending radially from the sleeve portion, and each bent rib has an upper end angled to extend radially outward to be received in each arched plate portion. The upper angled end has an annular flange to engage with a circumferentially extending narrow expanded portion of the arched plate portion.

The present exemplary preferred embodiment will be described in detail with reference to the following drawings, in which:

DETAILED DESCRIPTION OF THE PREFERRED EMBODIMENT

Figure 1:
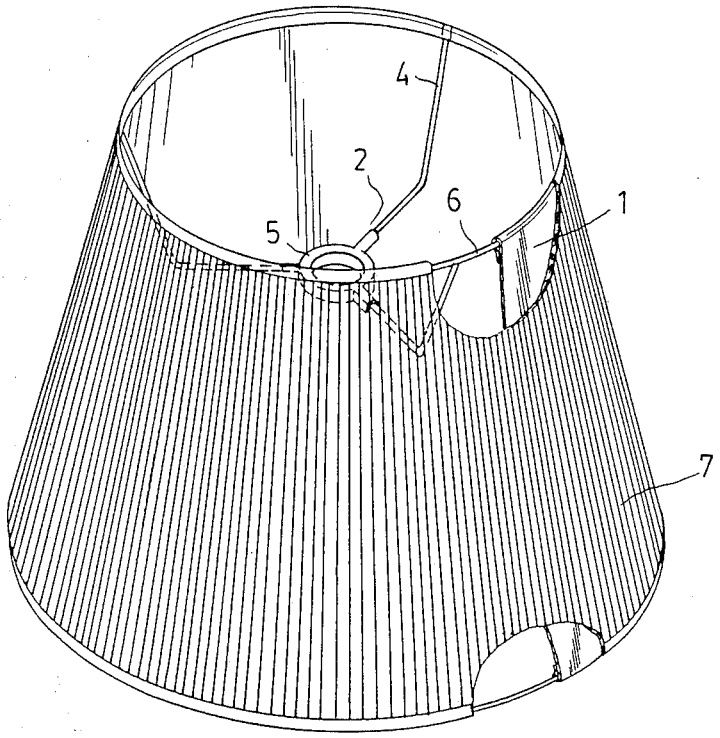
PRIOR ART FIG.1
FIGS. 1 and 2 show a typical conventional lampshade.
Figure 2:
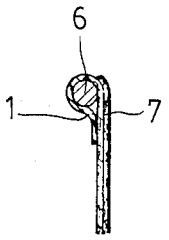
Figure 3:
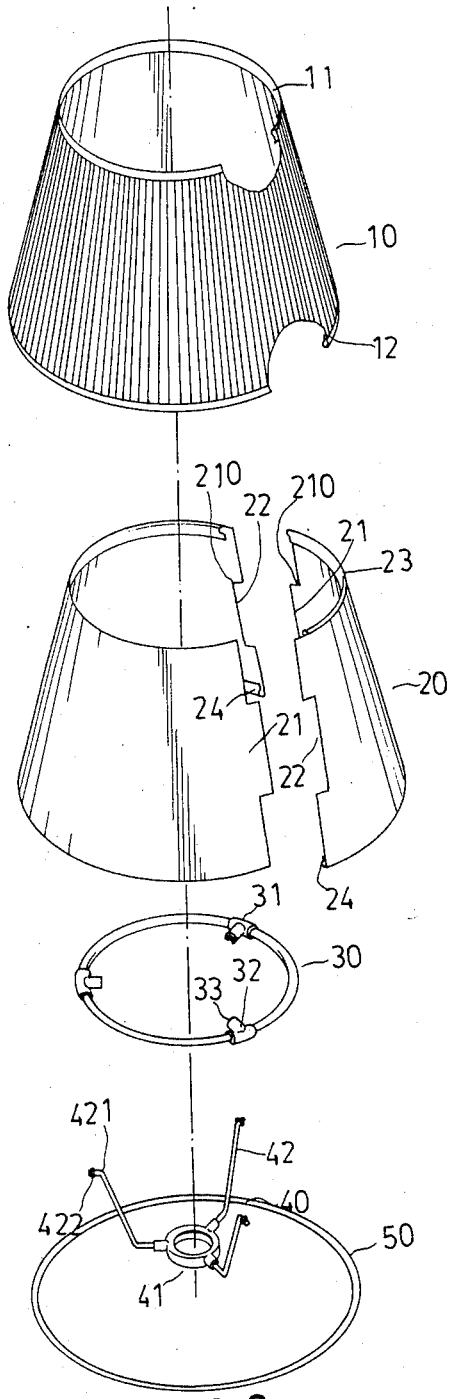
FIG. 3 shows an exploded view of a lampshade of the invention.
Figure 4:
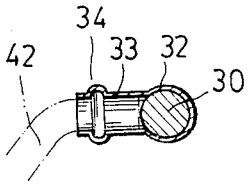
FIG. 4 is a fragmentary view of the lampshade of FIG. 3 showing the attachment member of the upper ring of the lampshade.
Figure 5:
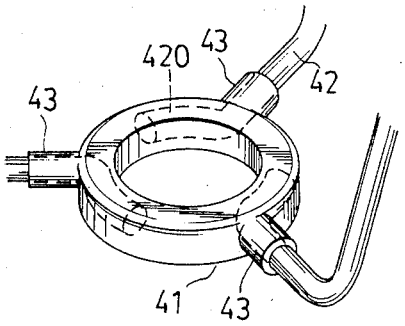
FIG. 5 is another fragmentary view of the lampshade of FIG. 3 showing the rib holding ring of the lampshade.
Figure 6:
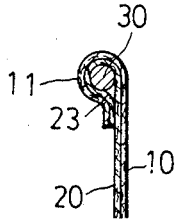
FIG. 6 is another fragmentary view of the lampshade of FIG. 3 showing the hooking edge of a curved plate and the hooking rim of the outer cover.

Referring to FIGS. 3 to 6, an embodiment of the lampshade of the invention is shown, including a corrugated hollow outer cover 10 of truncated cone shape, made of a high strength paper or a fabric material, having an upper hooking rim member 11 curved inwardly and a lower hooking rim member 12 curved inwardly. The rim members 11 and 12 may be made of paper or metal and are attached to the corrugated cover 10 by being sewed or bonded adhesively thereto. There are three curved plates 20 which underlie the corrugated cover 10 and each of which is shaped to a segment of a truncated hollow cone so as to be connected to one another to form an inner lining of the outer cover 10. Each curved plate 20 has an inwardly curved upper hooking edge 23, an inwardly curved lower hooking edge 24, and two opposite lateral sides to be jointed with other adjacent curved plate. Two lateral sides of each curved plate 20 are provided with engaging tongues 21 and grooves 22 which define right-angled shoulder formations 210.

An upper ring 30 is provided to unite the upper portions of the curved plates 20, and a lower ring 50 is provided to unite the lower portions of the curved plates 20.

On the upper ring 30 are mounted three attachment members 31 at equal intervals. Each of the attachment members 31 has a sleeve portion 32 which is sleeved on the upper ring 30, and an arched plate portion 33 of substantially C-shaped cross-section extending from the sleeve portion 32 in a direction radially inward from the upper ring 30. The arched plate portion 33 opens at its downward side and has an expanded portion 34 with an enlarged cross-section.

A rib assembly 40 is attached releaseably to the upper ring 30, and includes a rib holding circular ring 41 having a cross-section of substantially U-shape in a plane perpendicular to the plate of the ring 41 and opening downwards. At the outer periphery of the rib holding ring 41 are three tubular members 43 which are spaced apart and extend radially outward from the ring 41. Three bent ribs 42 extend upward from the rib holding ring 41. Each bent rib has a lower angled end 420 inserted into the circular ring 41 through each tubular member 43. Each bent rib 42 extends radially from the rib holding ring 41 and then bends upward. The upper angled end 421 to extend into each arched plate portion 33 of the ring 30 is provided with an annular flange 422. The ribs 42 so arranged can be turned relative to the rib holding ring 41 to a position in which the lower angled ends 420 are perpendicular to the plane of the ring 41 so that the remaining portions of the ribs can lie in the plane of the ring 41.

In assembly, the angled ends 421 of the ribs 42 are press fitted in the arched plate portions 33 of the attachment members 31, engaging the flanges 422 of the ribs 42 respectively with the expanded portions 34 of the arched plate portions 33. Then, the curved plates 20 are interconnected together by hooking up the upper ring 30 and the lower ring 50 with the upper hooking edges 23 and the lower hooking edges 24 of the curved plates 20. Finally, the outer cover 10 is put over the curved plates 20 with the upper and lower hooking rim members 11 and 12 being hooked on the upper and lower hooking edges 23 and 24 respectively.

It can be appreciated that, since the lampshade according to the present invention is constituted of separate parts which can be assembled easily, it can be packed in pieces and transported in a smaller package, thereby reducing the cost of transportation as well as preventing the deformation which occurs when the lampshades are stacked in tiers.

With the invention thus explained, it is apparent that various modifications and variations can be made without departing from the scope of the invention. It is therefore intended that the invention be limited as indicated in the appended claims.

What I claim is:

1. A lampshade comprising:

a corrugated hollow outer cover of truncated cone shape having an upper hooking rim member curved inwardly and a lower hooking rim member curved inwardly;

a plurality of curved plates each shaped to a segment of a truncated hollow cone so as to be connected to another to form an inner lining of said outer cover, each of said curved plates having an inwardly curved upper hooking edge which can be received in said upper hooking rim member, an inwardly curved lower hooking edge which can be received in said lower hooking rim member, and two opposite lateral sides to be jointed with the other adjacent said curved plate;

an upper ring to be hooked up by said upper hooking edges, having attachment members at intervals;

a rib assembly having a rib holding circular ring with a cross-section of U-shape in a plane perpendicular to the plane of said rib holding ring and with an outer periphery which has spaced apart tubular members extending radially outward therefrom, and a plurality of bent ribs extending upward from said rib holding ring, each of said bent ribs having a lower angled end inserted into said rib holding ring through each of said tubular members and an upper angled end to be connected releaseably to said upper ring, each of said bent ribs extending radially and outwardly from said rib holding ring and then bent upward towards said upper ring; and a lower ring to be hooked up by said lower hooking edges of said curved plates.

2. A lampshade as claimed in claim 1, wherein said lateral sides of each of said curved plates are provided with engaging tongues and grooves which define right-angled shoulders.

3. A lampshade as claimed in claim 1, wherein each of said attachment members includes a sleeve portion sleeved around said upper ring, and an arched plate portion which has a substantially C-shaped cross-section, extending radially inward from said sleeve portion for receiving each of said upper angled ends.

4. A lampshade as claimed in claim 3, wherein each of said upper angled end has an annular flange thereon, and each of said arched plate portions has an expanded portion of enlarged cross-section.

5. A lampshade as claimed in 4, wherein said corrugated outer cover is made of a material selected from paper and a fabric material.

* * * * *